United States Patent [19]

Sawyer et al.

[11] Patent Number: 5,038,590

[45] Date of Patent: Aug. 13, 1991

[54] KEY IDENTIFICATION COVER

[76] Inventors: Virginia E. Sawyer; Marshall H. Sawyer, both of 1002 Hudson Ave., Salt Lake City, Utah 84106

[21] Appl. No.: 480,251

[22] Filed: Feb. 15, 1990

[51] Int. Cl.[5] ..... A47G 29/10

[52] U.S. Cl. ..... 70/458; 70/408; 70/457

[58] Field of Search ..... 70/40 B, 456 R, 456 B, 70/457, 458, 459; 206/37.1, 37.2, 37.3, 37.4, 37.5, 37.6, 37.7, 37.8

[56] References Cited

U.S. PATENT DOCUMENTS

| | | | |
|---|---|---|---|
| 1,837,114 | 12/1931 | Cicourel | 70/40 B |
| 2,605,802 | 8/1952 | Baldwin | 206/37.4 |
| 3,618,346 | 11/1971 | Humphrey . | |
| 4,305,267 | 12/1981 | Nish et al. . | |
| 4,403,487 | 9/1983 | Marty . | |
| 4,425,772 | 1/1984 | Brewer . | |
| 4,432,219 | 2/1984 | Bassett | 70/456 R |
| 4,601,185 | 7/1986 | Sheldon . | |
| 4,768,362 | 9/1988 | Schmalz, Jr. . | |
| 4,826,002 | 5/1989 | Matuura . | |

FOREIGN PATENT DOCUMENTS

| | | | |
|---|---|---|---|
| 2712759 | 9/1978 | Fed. Rep. of Germany | 70/408 |

*Primary Examiner*—Robert L. Wolfe
*Attorney, Agent, or Firm*—Trask, Britt & Rossa

[57] ABSTRACT

The present invention comprises a key identification cover having universal adaptability to all manner of conventional keys. More specifically, the key cover of the present invention includes two substantially planar panels linked at their periphery by a hinge means having an aperture therethrough for receiving a key shank, and fastening means for securing the panels together at their periphery as they lie against a key head. Identifier means for identifying the lock for which the covered key is intended are associated with at least one of the panels, and may comprise labels or other markings. The key cover, or at least a portion of the panel carrying the identifier means, is substantially transparent so as to permit the placement of the identifier means in a protected position while enabling the user to view it.

21 Claims, 1 Drawing Sheet

KEY IDENTIFICATION COVER

BACKGROUND OF THE INVENTION

The present invention relates to a key cover, and more particularly to an easily applied key cover including means for identifying the lock which the covered key is intended to fit.

Since the commencement of the use of locks, key identification as to which lock a key is intended to fit has posed a problem. The advent of modern locks and locking systems which employ flat metal keys each having a head (also called a bow or tab) and a shank (also called a bit or shaft), has permitted the easy carrying of a large number of keys on a key ring or chain or in a key case, but the proliferation of keys to homes, garages, and offices, not to mention vehicles, renders it increasingly more difficult to sort through a group of keys and readily locate the right one. The fact that a number of keys from a given manufacturer may be virtually identical, except for the pattern of notches in the key shank, compounds this problem.

A number of attempts have been made in the past to mark or otherwise identify the destination lock for a particular key. For example, U.S. Pat. No. 312,545 discloses a key having a slot or recess in one side of the head into which a plate having an identifier thereon may be inserted; U.S. Pat. No. 2,549,228 discloses a key holder comprising two parallel flanges having a shaft at one end for extension through the hole in a key head, whereby the key can be rotated to fit between the flanges and an identifier placed on the outside of one of the flanges; U.S Pat. No. 3,618,346 discloses an identifier system using keys having abbreviated heads which are placed side by side in a key holder having a shaft at one end extending through parallel panels for securing the keys by their heads in the holder, and a cross-member extending between the panels and under the key shafts for receiving labels to identify each key; U.S. Pat. No. 4,305,267 discloses a one-piece key cover which stretches over the end or head of a key and covers one side thereof; U.S. Pat. No. 4,403,487 discloses a one-piece key identification cover into which a key is inserted bit first through a slot in the cover side, and the cover stretched around the head; U.S. Pat. No. 4,425,772 disclosed a key labeling system which uses elongated loops of wire, one end of each loop passing through a key head aperture, the other around a metal split key ring, the loop area between the ends being surrounded by a resilient sleeve carrying identifying indicia thereon; U.S. Pat. No. 4,601,185 discloses a key identifier comprising a series of strips or tabs on a key ring each secured to a key and extending beyond the shaft or bit tip of the key, each strip having an identifying shape on the end for selection of the correct key by the user; U.S. Pat. No. 4,768,362 discloses a one-piece elastic key marker which stretches over the head of a key, and on which an identifying inscription can be placed. In addition to the foregoing, U.S. Pat. No. 1,837,114 discloses a resilient sheet metal key head cover having tabs to fold over and grip the key head; U.S. Pat. No. 4,826,002 discloses several embodiments of a key case which covers the key head or tab and enhances the esthetics as well as facilitating the gripping of the key by the user.

All of the foregoing prior art attempts to produce a key cover possess drawbacks to practical use. For example, the identifier of U.S. Pat. No. 312,545 must use a specially made key; the identifiers of U.S Pat. Nos. 2,549,228, 4,425,772 and 4,601,185 add unacceptable bulk to a group of keys, are relatively expensive to produce and/or require assembly by the user when placing keys therewith; the identifier of U.S. Pat. No. 3,618,346 not only requires keys with special heads but also renders it impossible to view the key labels while the key shafts are in the holder; the stretch-fit key head covers of U.S. Pat. Nos. 4,305,267, 4,403,487 and 4,768,362 are of such design that they are difficult to apply for a person, such as an elderly person, having limited hand and finger strength and dexterity and in addition must be shaped at least in part to fit the key head shape; the cover of U.S. Pat. No. 1,837,114 is of metal and its tabs or flanges can snag the purse or pocket of the user, and in addition it, too, requires a shape to match that of the key head in order to provide a good, secure fit; the cover of U.S. Pat. No. 4,826,002 requires complex injection molding dies and adds significant bulk to both the sides and periphery of the enclosed key, and limits the size and shape of the key head being enclosed.

SUMMARY OF THE INVENTION

In contrast to the prior art, the key identification cover of the present invention comprises a universal, readily applied one-piece cover which may be easily marked or labelled to facilitate selection of the desired key by the user.

The key identification cover of the present invention comprises, in its preferred embodiment, two plates or panels secured together by spaced hinge tabs. The plates or panels, when the cover is installed on a key, lie flat against the sides of the key head, while the hinge tabs extend between the panels on the shaft side of the key head, one on each side of the shaft. The panels may have protrusions extending above the key head opposite the shaft side, where they are mutually secured via a snap type fastening means, or the fastening means may be located within the area of the panels themselves. The panels can be pierced to permit the passing of a key ring, chain or hook there through and through the eye or hole of the key, or the cover holes can be placed above or to one side of the area covering the key head. A label may be taped or otherwise adhesively affixed to the exterior of one or both of the cover panels or, if desired, the cover may be made of transparent material and the key identifying indicia written with indelible marker on the inside of a panel or placed on a label affixed writing-side-out to the interior of one or both panels. In all of the embodiments, the cover is formed in one piece of a resilient, preferably elastomeric, non-metallic material.

Thus, there has been described a simple, cheaply producable and easily usable key indentification cover which is universally adaptable to any substantially flat key having a head and shank.

BRIEF DESCRIPTION OF THE DRAWINGS

The key identification cover of the present invention will be more fully understood by one of ordinary skill in the art through a review of the following detailed description of the preferred embodiments taken in conjunction with the accompanying drawings, wherein.

DETAILED DESCRIPTION OF THE PREFERRED EMBODIMENTS

Figures 1A, 1B:
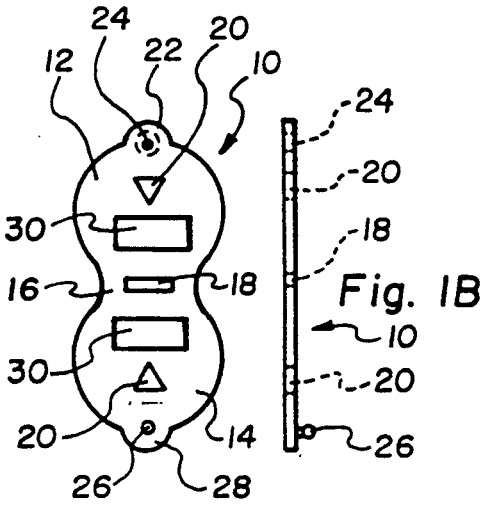
FIGS. 1A and 1B comprise a front and side elevation, respectively, of a first preferred embodiment of the present invention.

Referring now to FIGS. 1A and 1B of the drawings, a first preferred embodiment 10 of the key identification cover of the present invention will be described in detail. Key cover 10 comprises two panels 12 and 14 which are linked at their bottom edges by hinge 16 having key shank aperture 18 extending therethrough. Each panel includes a key holder aperture 20 therein, key holder apertures 20 being aligned when key identification cover 10 is folded at hinge 16, thereby permitting a key ring, hook or other holder to pass therethrough so that a plurality of keys may be grouped for use.

Tab 22 protrudes from the top of panel 12 and substantially surrounds frustoconical snap hole 24, the smaller end of whch is sized to interference fit with snap ball 26 extending laterally from tab 28 at the top of panel 14.

Key cover 10 is preferably formed of a plastic or other elastomeric material which is formed in a molding process known in the art, such as injection molding. Suitable materials include, but are not limited to, vinyl and urethane compositions. Ideally, the material employed will be flexible and resilient at a normal range of ambient temperatures, such as at least zero degrees to 100 degrees Fahrenheit. Such flexibility will permit easy bending at hinge 16 and permit slight temporary stretching at snap hold 24 when snap ball 26 passes therethrough. The material employed in cover 10 is also at least in part preferably transparent, so that identifying wording or symbols may be placed on the interior of cover 10 after installation on a key and be visible and yet wear resistant. Adhesive labels may also be employed for key identification, or small identifier plates which are sized to interference fit within recesses on the interior of the panels. Such identifier means, of whatever type, are generally designated by numeral 30.

Figure 4A:
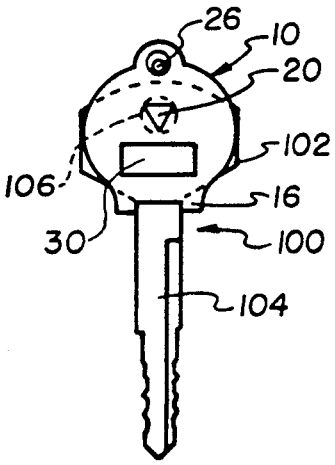
FIGS. 4A and 4B comprise front and side elevations of the first embodiment of the key identification cover of the present invention installed on a key.
Figure 4B:
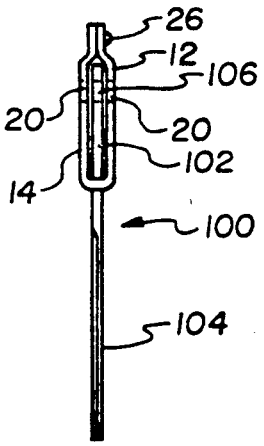

Referring now to FIGS. 4A and 4B of the drawings, key cover 10 is shown after installation on an exemplary key 100. Key 100, which includes a head 102 and a shank 104, is inserted through shank aperture 18 in hinge 16, and panels 12 and 14 are folded upwardly about key head 104 to a position, as best depicted in FIG. 4B, where they lie adjacent and parallel to key head 102. One portion of hinge 16 passes around each side of key shank 104 so as to link panels 12 and 14 in the folded position of cover 10 and to promote the alignment of snap ball 26 with snap hold 24 so that the panels are securely held together at both top and bottom when snap ball 26 passes through snap hold 24, stretching the smaller end thereof, snap hole 24 then relaxing after the ball's passage so that snap ball is incapable of easily passing back therethrough.

Depending upon the size of key head 102, only tabs 22 and 28 may overlap and extend beyond the top of the key head, or a portion of the panel tops may also extend therebeyond. In either instance, key head 102 is held securely within cover 10, and there is enough overlap of key holder apertures 20 in panels 12 and 14 with key head hole 106 to permit a key ring, hook or other holding means to pass therethrough. Identifier means 30 may be applied to one or both panels of cover 10 to identify the destination lock for key 100. The same or different identifiers may be used on both panels; different identifiers may be used, for example, when one is used to identify a particular dwelling and the other a particular entry door for that dwelling.

Figures 2A, 2B:
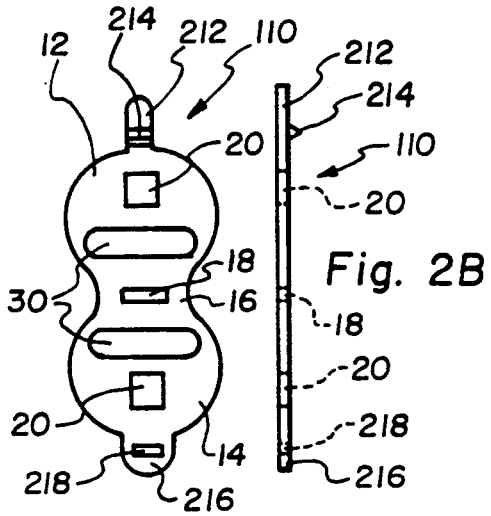
FIGS. 2A and 2B comprise a front and a side elevation, respectively, of a second preferred embodiment of the present invention.
Figures 6A, 6B:
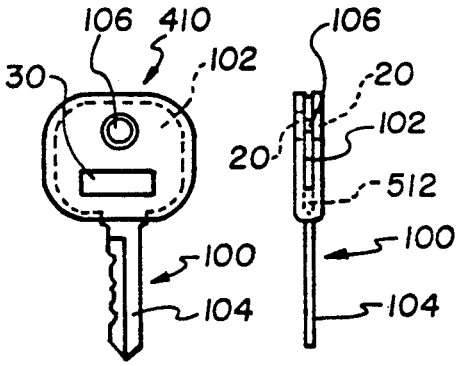
FIGS. 6A and 6B comprise a front and a side elevation, respectively, of a fifth preferred embodiment of the present invention.
Figures 3A, 3B:
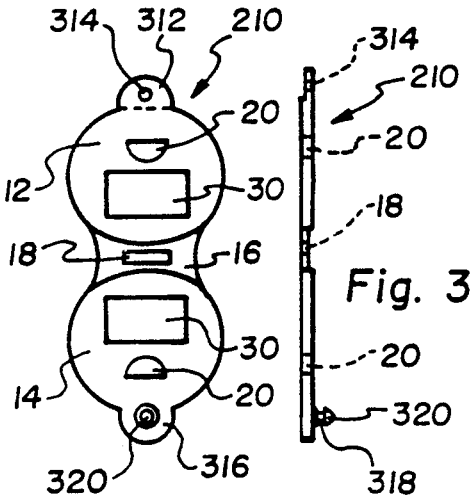
FIGS. 3A and 3B comprise a front and a side elevation, respectively, of a third preferred embodiment of the present invention.
Figure 5A:
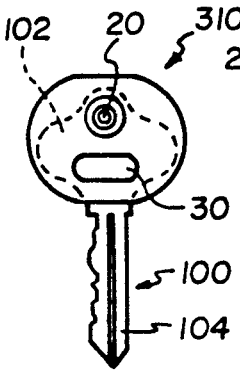
FIGS. 5A and 5B comprise a front and a side elevation, respectively, of a fourth preferred embodiment of the present invention.
Figure 5B:
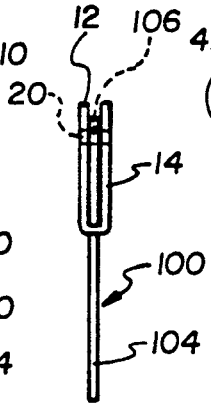

Other embodiments of the key identification cover of the present invention are equally feasible. A second preferred embodiment of the invention, key cover 110, is depicted in FIGS. 2A and 2B; a third, key cover 210, in FIGS. 3A and 3B; a fourth, key cover 310, in FIGS. 5A and 5B; a fifth, key cover 410, in FIGS. 6A and 6B. In describing key covers 110, 210, 310 and 410, the same numerals will be used to describe features and elements substantially the same as those on cover 10.

Key cover 110 comprises two panels, 12 and 14, linked at their bottoms by hinge 16 having a key shank aperture 18 extending therethrough. Panels 12 and 14 each include a key holder aperture 20 and an identifier means 30. Panel 12 includes a fastener tongue 212 extending from the top thereof, tongue 212 having a laterally extending, horizontally oriented lip or shoulder 214 thereon. Panel 14 includes a fastener tab 216 protruding from the top thereof, tab 216 including a laterally extending slot 218 adapted to receive tongue 212 therein and to temporarily stretch to accomodate the passage of lip or shoulder 214 therethrough. Key cover 110 is installed on a key in the same manner as cover 10, except that tongue 212 and lip 214 is passed through slot 216 to hold the tops of panels 12 and 14 together and thus secure cover 110 to a key. Tongue 212 is prevented from passing back through slot 218 by the presence of lip 214.

Key cover 210 comprises panels 12 and 14, which are linked at their bottoms by hinge 16 having key shank aperture 18 extending therethrough. Panels 12 and 14 each include a key holder aperture 20 and may each include an identifier means 30 as shown. Hinge 16 of cover 210 differs from that of the other embodiments in that, as shown in FIGS. 3, it is thinner than panels 12 and 14 to promote flexing or bending as panels 12 and 14 are folded about a key. At the top of panel 12, tab 312 extends upwardly and defines a fastener hole 314. At the top of panel 14, tab 316 extends upwardly and includes fastener pin 318 having head 320 at the tip thereof. When cover 210 is folded about a key so that panels 12 and 14 lie against the sides of the key head, cover 210 is maintained on the key by passing fastener head 320 through fastener hole 314, fastener hole 314 being dimensioned so as to be smaller than head 320 but large enough to accomodate its passage by stretching of the key cover material. Passage of head 320 back through the hole 314 is prevented by subsequent relaxation of the material surrounding the hole. It should also be noted that the cross section of tab 312 is thinner than that of panel 12 so as to permit easier stretching of the material surrounding the hole, to permit the positive gripping of tab 312 on fastener pin 318 between head 320 and tab 316 and to provide a recess to accomodate the end of head 320 so that it does not protrude significantly beyond panel 12 when cover 210 is installed on a key to minimize snagging on pocket or purse material and to prevent discomfort to the hand of the key user.

Key cover 310 comprises panels 12 and 14, which are linked at their bottoms by hinge 16 having key aperture 18 extending therethrough. Panels 12 and 14 may each include a key identifier means 30. Hinge 16 of cover 310, like that of cover 210, is thinner than panels 12 and 14 to promote flexing or bending. Cover 310 includes key holder apertures 20, which also comprise part of the fastening means to secure panel 12 to panel 14. Aperture 20 of panel 12 is defined by tubular fastener pin 412 topped by truncated conical head 414 which, when inserted through key holder aperture 20 of panel 14, expands outwardly thereafter and is retained by engagement with circumstantial shoulder 416 at the bottom of annular recess 418 surrounding aperture 20 of panel 14. Key cover 310 can thus be designed so that apertures 20 are in general alignment with a key head hole 106 of a key 100 so that a key ring or chain may pass through both, or apertures 20 may (although this arrangement is less preferred) be offset to the top or side of the key cover panels so as to clear the key head 102 and permit passage of a key ring, hook, chain or other holding means.

Figure 5C:
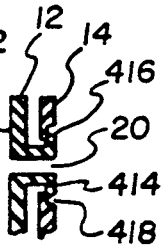
FIG. 5C comprises an enlarged section of the fastener used in the fourth embodiment.

Key cover 410 comprises panels 12 and 14 which are secured at their bottoms by a hinge 16 which, unlike the hinges of the other embodiments of the key cover of the present invention, extends not only along the adjacent bottoms of panels 12 and 14, but partially up the adjacent sides to form a key head pocket 512 as panels 12 and 14 in this embodiment are prepositioned in spaced parallel relationship to permit insertion of a key therebetween. Key holder apertures 20 are of a size and position that they will generally align with a key head hole of a key inserted between panels 12 and 14 with its shank extending downwardly through key shank aperture 18, so that passage of a key holder (chain, ring, hook etc.) through to the key head hole and apertures 20 in cover 410 will serve to maintain key cover 410 on the key. Again, as with the embodiment of FIGS. 5, apertures 20 may be located in cover 410 so as to clear the top of the key head, although this is a less preferred alternative because of the bulk added to the cover. As with the other embodiments, key identifier means 30 may be associated with either or both of panels 12 and 14.

As can be seen from the drawings of the preferred embodiments, many features of the inventions may differ in detail while still being within the scope of the claimed invention. For example, the size, shape and location of the keyholder apertures, identifier means, tabs and the size and shape of the key cover panels themselves may vary. Similarly, the means of securing the key cover to the key may take any one of a number of forms, and those illustrated are intended as exemplary only and not as limiting the invention. Material choice and thickness of the various elements of the key cover of the present invention are dictated only by desired strength, wear, flexibility and transparency characteristics. Many other additions, deletions and modifications to the invention as depicted and described in the preferred embodiments are contemplated, and will be appreciated by those of ordinary skill in the art.

We claim:

1. A key cover for identifying a lock corresponding to a key having a head with a hole therethrough and a shank extending therefrom, on which the cover is installed, comprising:

first and second substantially planar panels, each of said panels including a key holder aperture therethrough and at least one of said panels having lock identifier means associated therewith;

hinge means linking said panels at their periphery and defining an aperture for the passage of a key shank therethrough; and fastener means for securing said panels together in a mutually parallel relationship with said key head therebetween and said key holder apertures in mutual substantial alignment with said key head hole.

2. The key cover of claim 1, wherein said panels, said hinge means and said fastener means are integrally formed.

3. The key cover of claim 1, wherein a least the portion of said panel possessing said identifier means is substantially transparent.

4. The key cover of claim 1, wherein said fastener means comprises snap fastener means associated with said panels.

5. The key cover of claim 4, wherein said first component of said fastener means comprises a snap ball, and the said second component of said fastener means comprises a frustoconical aperture for receiving said snap ball in gripping engagement.

6. The key cover of claim 4, wherein said first component comprises a pin having a head thereon, and said second component comprises an aperture for receiving said head therethrough and surrounding said pin after passage of said head.

7. The key cover of claim 6, wherein said pin is tubular in configuration and the bore thereof defines said key holder apertures.

8. The key cover of claim 1, wherein said fastener means components are located at the periphery of their respective panels opposite said hinge means linking said panels.

9. The key cover of claim 1, wherein said fastener means components are located on tab means extending from the periphery of said panels.

10. The key cover of claim 1, wherein said first component of said fastener means comprises a tongue extending from the periphery of one of said panels, and said second component comprises a slot for receiving said tongue.

11. The key cover of claim 10, wherein said tongue further includes a lip thereon.

12. The key cover of claim 11, wherein said slot is defined by a tab protruding from a panel periphery.

13. The key cover of claim 1, wherein said panels are disposed in mutually parallel relationship, and said hinge means extend up at least a portion of the sides of said panels.

14. A method of identifying an intended lock for a key to be inserted therein, comprising:

providing a key cover having two substantially planar panels including key holder apertures and linked at their periphery by a hinge means including a key shank aperture;

placing identifier means on at least one of said panels for identifying the lock for which the key is intended;

inserting the shank of a key including a head and having a hole therethrough and a shank extending therefrom through said key shank aperture until said hinge means is adjacent the head of said key;

folding said panels upwardly about the head of said key until said panels lie adjacent said key head and said key head hole and said key holder apertures are in substantial mutual alignment; and fastening said panels together at a single location removed from said hinge means.

15. The method of claim 14, wherein said step of fastening is performed proximate a location on said panels substantially opposite the location of said hinge means.

16. The method of claim 14, wherein said step of providing comprises fabricating said key cover as a single piece.

17. The method of claim 16, wherein said step of fabricating comprises injection molding of a non-metallic material.

18. The method of claim 14, wherein said step of placing further comprises placing said identifier means on a side of a panel which will be interior of the cover upon folding of said panels, said panel including at least one substantially transparent portion for viewing said identifier means on said interior.

19. The method of claim 14, wherein said step of fastening comprises snapping said panels together.

20. A method of securing a key cover to a key, comprising:

providing a key cover having two substantially planar and substantially parallel panels having aligned key holder apertures therethrough and linked at their bottoms and at least a portion of their sides, so as to define a pocket, by a hinge means including a key shank aperture;

linearly inserting a key including a head having a hole therethrough and a shank extending therefrom between said parallel panels and into said pocket so that the shank of said key extends through said key shank aperture and the head of said key rests in said pocket;

substantially aligning said key head hole with said key holder apertures;

and mutually securing at least one of said panels and said key head.

21. The method of claim 20, wherein said panels and said key head each include an aperture therein, and said step of mutually securing comprises passing an elongated portion of a key holder means through said panel apertures and said key head aperture.

* * * * *